United States Patent [19]

Mansfield

[11] Patent Number: 4,624,082

[45] Date of Patent: Nov. 25, 1986

[54] GRID SYSTEM AND METHOD FOR CAST FORMING MONOLITHIC CONCRETE ROOF COVERING

[76] Inventor: Peter W. Mansfield, 511 59th St., Holmes Beach, Fla. 33510

[21] Appl. No.: 749,391

[22] Filed: Jun. 27, 1985

[51] Int. Cl.[4] ..... E04B 7/02; E04D 13/04

[52] U.S. Cl. ..... 52/11; 52/91; 52/96; 52/309.12; 52/396; 52/748

[58] Field of Search ..... 52/91, 96, 314, 57, 52/396, 309.12, 748, 11

[56] References Cited

U.S. PATENT DOCUMENTS

| | | | |
|---|---|---|---|
| 430,370 | 6/1890 | Babcock | 52/57 |
| 552,787 | 1/1896 | Smith | 52/396 |
| 639,961 | 12/1899 | De Man | 52/396 |
| 1,274,987 | 8/1918 | Carroll | 52/91 X |
| 2,029,817 | 2/1936 | Fegles | 52/396 X |
| 2,193,233 | 3/1940 | Hardy | 52/416 X |
| 2,198,685 | 4/1940 | Wallace | 264/33 |
| 2,379,051 | 6/1945 | Wallace | 52/748 X |
| 2,543,939 | 3/1951 | Rumble | 52/418 X |
| 2,748,443 | 6/1956 | Dufford | 52/314 X |
| 3,222,436 | 12/1965 | Woodworth | 264/34 |
| 3,382,637 | 5/1968 | Longinotti | 52/309.12 X |

FOREIGN PATENT DOCUMENTS

| | | | |
|---|---|---|---|
| 264171 | 4/1929 | Italy | 52/96 |

*Primary Examiner*—Alfred C. Perham

*Attorney, Agent, or Firm*—Charles J. Prescott

[57] ABSTRACT

A reusable grid system and method for in place cast forming a monolithic roof covering for a sloped roof, the roof covering having the stepped and segmented appearance of a tiled roof. The grid system includes a plurality of horizontally disposed dam bars and transversly disposed spacer bars which, when removably assembled atop a sloped roof, are adapted to retain monolithic poured and scraped plastic uncured concrete or the like so as to have an exposed surface which substantially duplicates a conventional tile roof after curing and removal of the grid system. The cured roof covering is monolithic from one eave to peak to the other eave and may include foam-filled cavities for thermal insulation and weight reduction, longitudinal segmented elastomer-filled expansion joints, formed eaves with gutter connecting means and molded edges.

8 Claims, 20 Drawing Figures

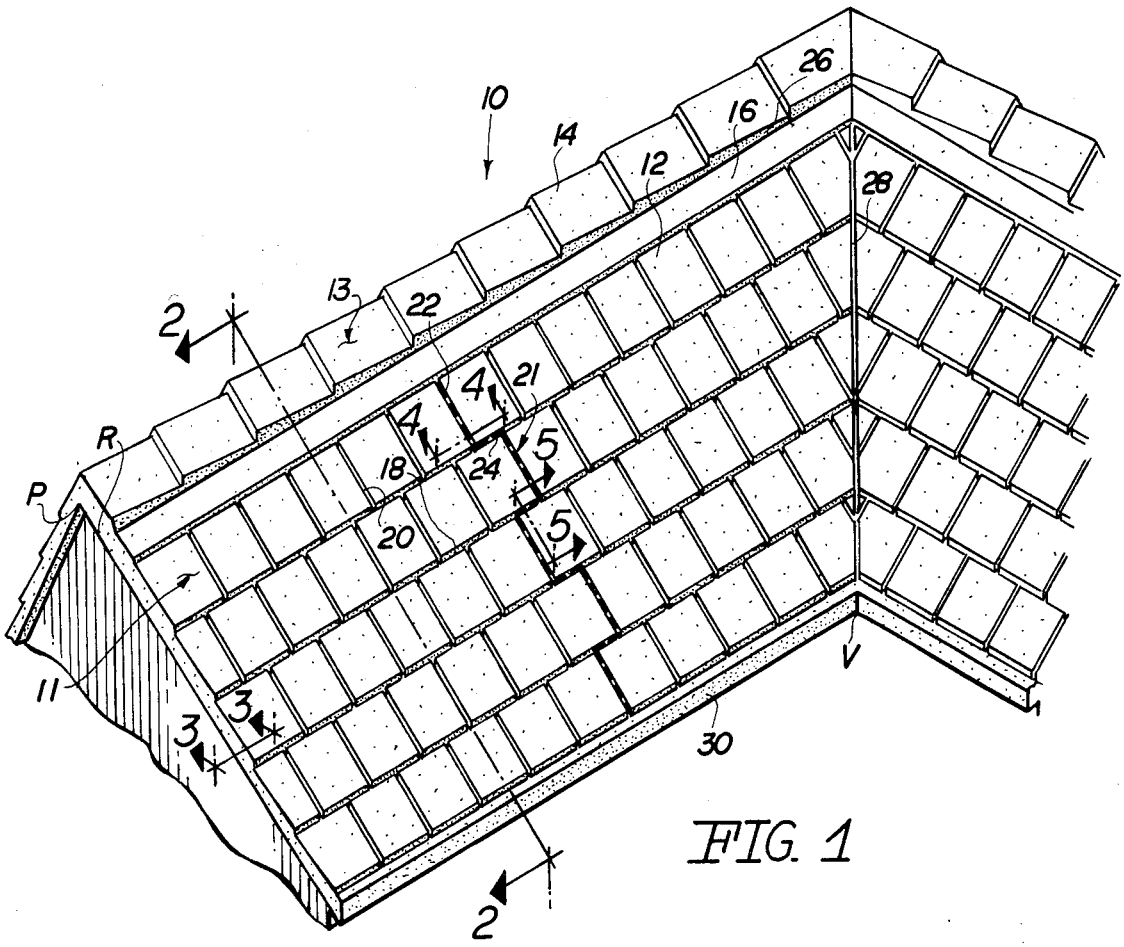
FIG. 1
FIG. 5
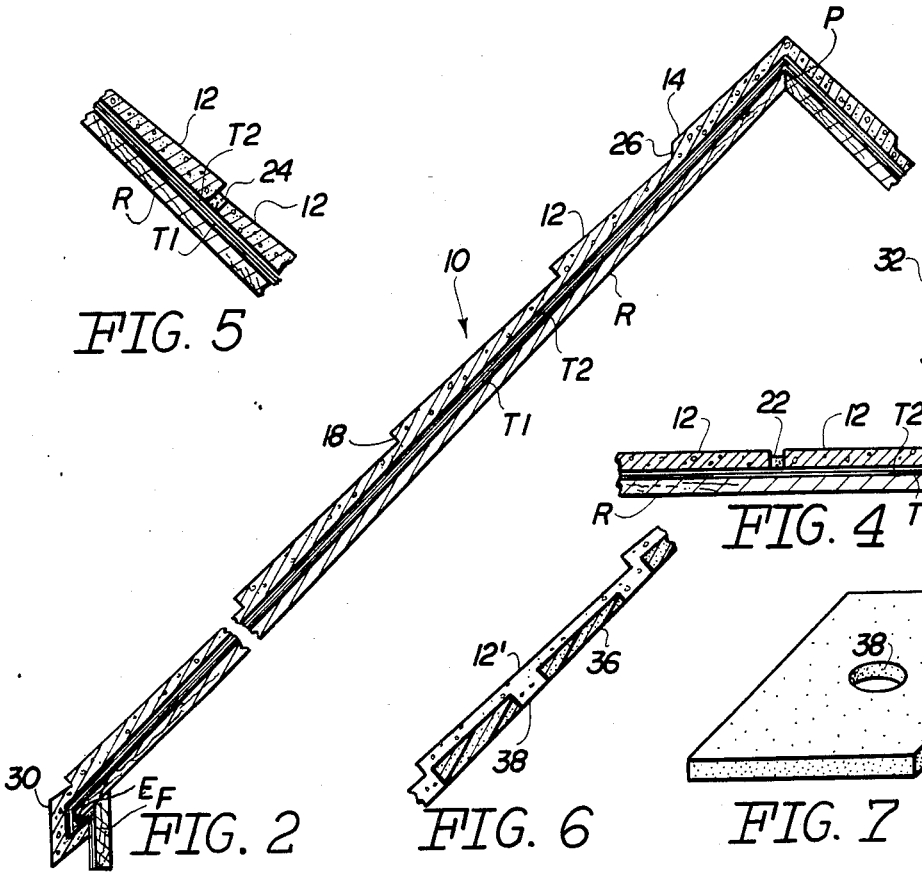
FIG. 2
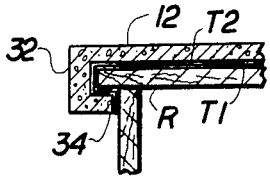
FIG. 3
FIG. 4
FIG. 6
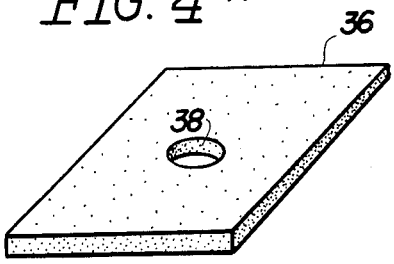
FIG. 7

GRID SYSTEM AND METHOD FOR CAST FORMING MONOLITHIC CONCRETE ROOF COVERING

BACKGROUND OF THE INVENTION

This invention relates generally to building roof coverings and more particularly to a poured monolithic concrete or other like pourable, hardenable material atop a sloped roof.

In the past, as an alternative to well-known tar shingled roofing, various coverings have been devised to provide roof protection which outlives and better protects underlying building roofs. Well-known clay tile roofing does provide longer useful service and also provides a unique aesthetic appearance. However, clay tiles are expensive, fragile and expensive to install.

A process for molding a roof slab of concrete or other plastic material is disclosed in U.S. Pat. No. 2,543,939 to Rumble. However, the process requires erection of support structure and produces a heavy, flat slab typical of commercial structures. In U.S. Pat. No. 2,193,233 to Hardy, another method is disclosed for producing a roof covering of thin individually cast labor-intensive mortar or concrete shingles which appear likened to individual roof tiles. Still other prior art in U.S. Pat. No. 2,379,051 to Wallace discloses a sectioned self-hardening plastic formed roof covering and method which includes a unique means for insuring that trapped moisture thereunder exists to the exposed surface. This feature mandates horizontal separated sections which are poured in place aided by simple individual rails and labor intensive techniques.

The present invention discloses a reusable grid system and method for cast forming a monolithic concrete or the like roof covering which has the finished appearance of tile roofing but which is continuous from peak to eave and which reduces installation cost and time over previous methods.

BRIEF SUMMARY OF THE INVENTION

The present invention is for a reusable grid system and method for in place cast forming a monolithic roof covering for a sloped roof, the roof covering having the stepped and segmented appearance of a tilted roof. The grid system includes a plurality of horizontally disposed dam bars and transversely disposed spacer bars which, when removably assembled atop a sloped roof, are adapted to retain monolithic poured and scraped plastic uncured concrete or the like to have an exposed surface which substantially duplicates a conventional tile roof. The cured roof covering is monolithic from one eave to peak to the other eave and may include foam-filled cavities for thermal insulation and weight reduction, longitudinal segmented elastomer-filled expanion joints, formed eaves with gutter connecting means and molded edges.

The grid system may also include both movable and fixed spacer bars as well as means for forming the valley between two adjacent roof sections.

It is therefore an object of this invention to provide a reusable grid system and method for in-place cast forming a continuous concrete or the like monolithic roof covering having the exposed appearance of conventional individual clay, concrete, or ceramic stepped tile.

It is another object of this invention to provide a monolithic concrete or the like roof covering which is economical to cast form in place atop a sloped roof.

It is still another object of this invention to provide the above roof covering having favorable weight reduction features and integral finished roof edge-and-eave encapsulating contours and embedded gutter fasterners for use.

In accordance with these and other objects which will become apparent hereinafter, the instant invention will now be described with reference to the accompanying drawings in which:

BRIEF DESCRIPTION OF THE DRAWINGS

FIG. 1 is a perspective view of the monolithic roof covering according to the present invention.

FIG. 2 is a section view in the direction of arrows 2—2 in FIG. 1.

FIG. 3 is a section view in the direction of arrows 3—3 in FIG. 1.

FIG. 4 is a section view in the direction of arrows 4—4 in FIG. 1.

FIG. 5 is a section view in the direction of arrows 5—5 in FIG. 1.

FIG. 6 is a portion of a section view similar to FIG. 2 of an alternate embodiment of the roof covering.

FIG. 7 is a perspective view of an insulating and weight reducing plate which may be embedded in the roof covering during cast forming.

DETAILED DESCRIPTION OF THE INVENTION

Figures 8, 9, 10, 11, 12:
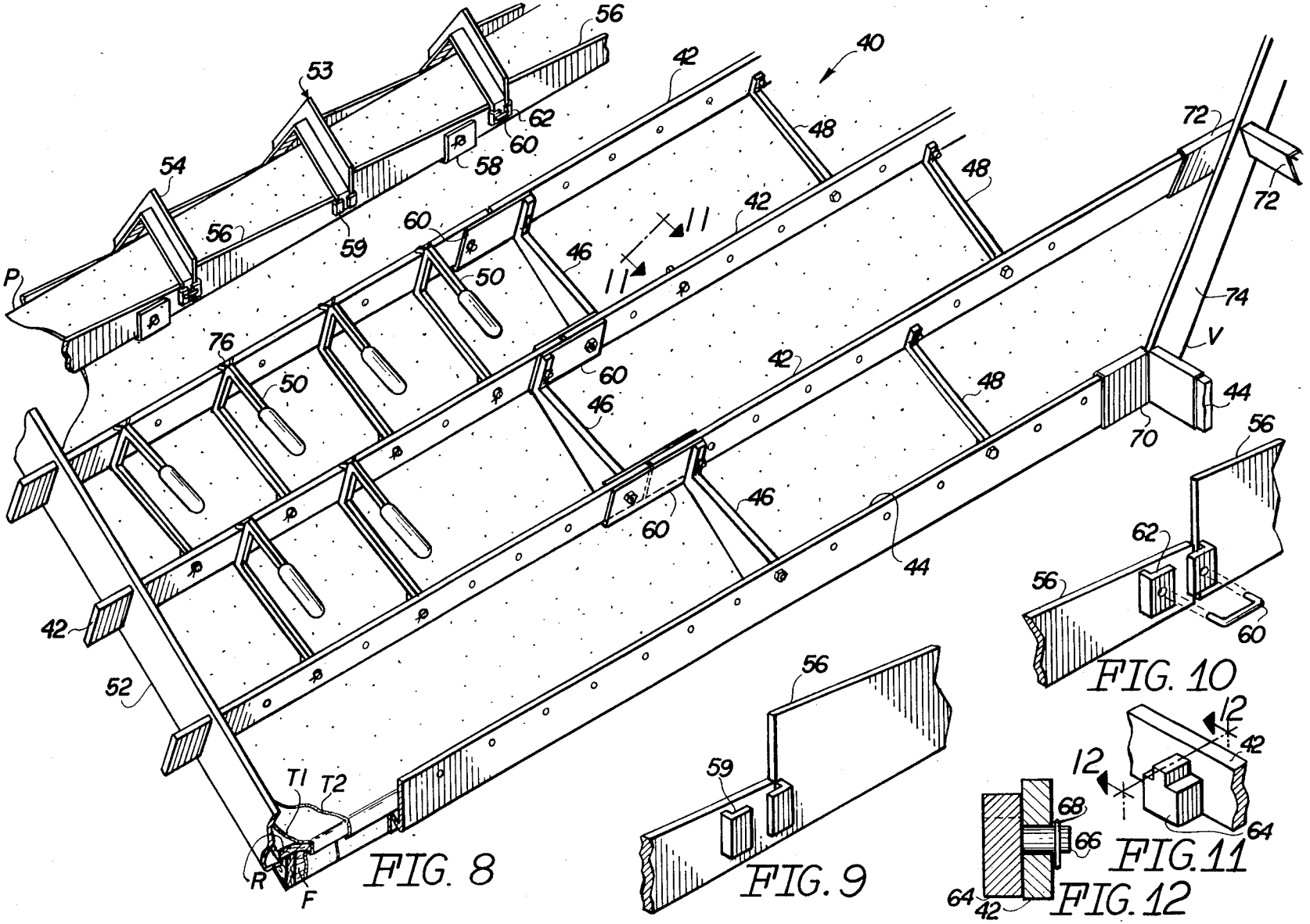
FIG. 8 is a perspective view of the grid system of the present invention.
FIG. 9 is a perspective view of the angle peak bar retention bracket.
FIG. 10 is a perspective view of the connection between side bar segments of the peak grid.
FIG. 11 is a perspective view of one embodiment of the lower end movable spacer support means in the direction of arrows 11—11 in FIG. 8.
FIG. 12 is a section view in the direction of arrows 12—12 in FIG. 11.

Referring now to the drawings, and particularly to FIGS. 1 through 5, the subsurface of roof covering of the present invention is shown generally by the numeral 10 poured or cast formed in place atop the roof R of pourable, hardenable material such as concrete or the like. The roof covering 10 includes a plurality of rows 11 of panel portions 12, each adjacent panel portion 12 separated and defined by a recess line 20, each row 11 of panel portions 12 defined by a horizontal row edge 18. The recess lines 20 penetrate into the top or exposed surface of each row but do not go to the roof or tarpaper T1 or T2 which may be therebetween. These recess lines 20 are disposed transversly to each row 11 in alignment with the slope of the roof R. Each horizontal row edge 18 runs from one roof edge to the other or to a valley V formed by the intersection of two adjacent roof portions. The plane of each horizontal row edge 18 is disposed generally perpendicular to the roof R at that particular line across the roof R, but does not go down to the roof R or tarpaper T1 and T2. For simplicity, the surface onto which the roof covering 10 of this invention is disposed, preferrably tarpaper T2, will be generally referred to hereinafter as the "subsurface".

Spanning and covering the peak P of the roof R is a roof peak cover 13 defined by a plurality of adjacent peak step portions 14 and parallel peak cover edge planes 26 disposed on either side of the peak P. Each peak cover edge plane 26 is generally perpendicular to ground as shown, but does not extend to the subsurface T2.

Disposed between the roof peak cover 13 and the uppermost row 11 having defined panel portions 12 is a variable width row 16, absent any recesses 20. The purpose for this variability in width is to accommodate virtually any roof slope length so as to maintain a predetermined uniform length of each recess 20.

As best seen in FIG. 2, two layers of moisture barrier tarpaper T1 and T2 are typically used in the industry to insure a complete barrier to the wood roof R by any moisture from above. The concrete roof covering 10 is then in-place formed atop the subsurfaces tar paper T2, rather than the bare wood The tar paper T1 and T2 are strongly adhered to the roof R by well known means while the pourable pre-cured concrete also strongly adheres to the upper layer of tarpaper T2 as it hardens.

Each row 11, as well as the entire roof cover 10 has edge boundaries defined either by a valley recess 28 or by edge portions 32 and 34 which encapsulate the roof edge as shown in FIG. 3. The two layers of tarpaper T1 and T2 first surround the exposed wood of the roof R, then concrete edge portions 32 and 34 encapsulate both the tarpaper T1 and T2 for both protection and finished appearance.

Similarly, as seen in FIG. 2, the eave E, along with a portion of the facia board F are first wrapped with tarpaper layers T1 and T2, then the eave portion 30 encapsulates the entire eave E as shown to provide maximum protection and a finished appearance.

As may now be better understood, the roof covering 10 is truly monolithic or continuous in section from roof eave-to-eave and from roof edge-to-edge while still having the exposed stepped, and segmented top surface of a conventional tile roof. The various concrete portions, while varying in thickness to achieve the exposed stepped surface, nonetheless are uninterrupted even over the peak P of the roof R.

One planned optional and preferred exception to this continuity of roof covering 10 is a thermal expansion joint 21 running in zig-zag fashion along substantially the entire slope of the roof R. This expansion joint 21 is formed by segments 24 of each row edge 18 and predetermined recesses 22, all of which are connected. The expansion joint 21 is filled with an elastomeric material so as to completely transect the roof covering 10 down to the subsurface tarpaper T2, Although not shown, this expansion joint may also transect the roof peak cover 13 and the variable width rows 16.

Referring now to FIGS. 8 to 12, the grid system for cast forming the previously described roof covering 10 is shown generally at 40. This grid system 40 includes a plurality of parallel spaced-apart elongated rigid dam bars 42 disposed horizontally across the roof and a plurality of elongated rigid spacer bars 46, 48 and 50 transversly disposed and supportively connectable to the dam bars 42. Each dam bar 42 is placed edgewise spaced above the surface tarpaper T2, such as to be generally perpendicular to the slope of the roof R as shown. These dam bars 42 are held displaced above and apart from the roof R by expansion joint splice 60 which may also serve to splice two dam bars 42 together. The flow gap formed between the bottom edge of each dam bar 42 and the subsurface, tarpaper T2 facilitates concrete flow therebetween during pouring.

Two styles of spacer bars 46 and 48 are releasably connectable to the dam bars 42 by conventional threaded fasteners so as to both properly space and align the dam bars 42 and also to securely retain them in the position shown during the pouring process. Note that while support spacer bars 48 are disposed above the subsurface, T2 expansion spacer bars 46 extend down to, and contact, the subsurface, tarpaper T2.

A third movable spacer bar 50 is removable or placeable between any two dam bars 42 as shown after the dam bars 42 and expansion and support spacer bars 46 and 48 have been bolted into position. Like the support spacer bar 48, the movable spacer bar 50, when in position, is disposed above the tarpaper T2 so as to form a flow gap therebetween. These movable spacer bars 50 may include handles and are made releasably positionable at their upper end by support fingers 76 resting upon the top edge of a dam bar 42 and at their lower end by mateable engagement to a support block 64 as best seen in FIGS. 11 and 12. These support blocks 64 are held in position by snap pins 68 into their shaft portions 66 as shown.

To form the previously described roof covering encapsulating edges 32 and 34, an edge form 52 having apertures therethrough is adapted to align and slide over the ends of the dam bars 42 and abutt against the edge of the roof. Having a generally "L" crosssection facilitates retention of the pourable concrete so as to accomplish the previously described roof edge encapsulation while the concrete cures.

To form the previously described stepped peak cover 13, a peak grid 53 is also included in the preferred embodiment of the grid system 40 and includes a pair of elongated side bars 56 placeable in spaced apart fashion horizontally atop the subsurface, tarpaper T2 and parallel to the peak P. Also included are a plurality of angle peak bars 54 which are releasably interconnectable transversly between the side bars 56 by "L" brackets 59 and 62 in FIGS. 9 and 10. These angle peak bars 54, generally matching the roof peak angle, span and are displaced above the subsurface at peak P so as to form a flow slot therebetween. The side bars 56 are also held above and displaced from the subsurface, tarpaper T2 to form flow slots therebetween by riser blocks 58. The angle peak bars 54 as best seen in FIGS. 9, supportively engage into mating "L" brackets 59 connected to the lower side of the side bars 56. Where the side bars 56 are spliced as shown in FIG. 10, these modified "L" brackets 62 also include apertures to receive a clip 60 for retaining the side bars 56 in aligned abuttment one to another as shown.

Where a finished and encapsulating roof cover eave 30, as previously described, is desired, an eave form 44 may also be included in the grid system 40. This eave form 44, elongated, rigid and having a generally "Z" crosssection, is clampable to the facia board F and so held during pouring of the concrete. With the tarpaper T1 and T2 wrapped and in place, clamped beneath the eave form 44, the eave incapsulating section 30, described and shown in FIG. 2 is accomplished.

To form the roof covering valley recess 28, a valley bar 74 is also provided which is placed edgewise in alignment with, and atop, the subsurface of the roof at valley V. The valley bar 72 is so held during concrete pouring by cornerplace 70, which telescopes over the adjacent eave forms 44, and by collars 72, which resistively telescope over the dam bars 42 to opposingly press against the sides of the valley bar 74.

Figure 13:
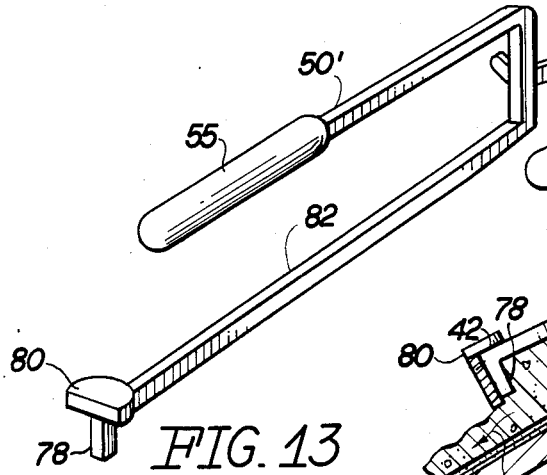
FIG. 13 is a perspective view of a second embodiment of the movable spacer bar.
Figure 14:
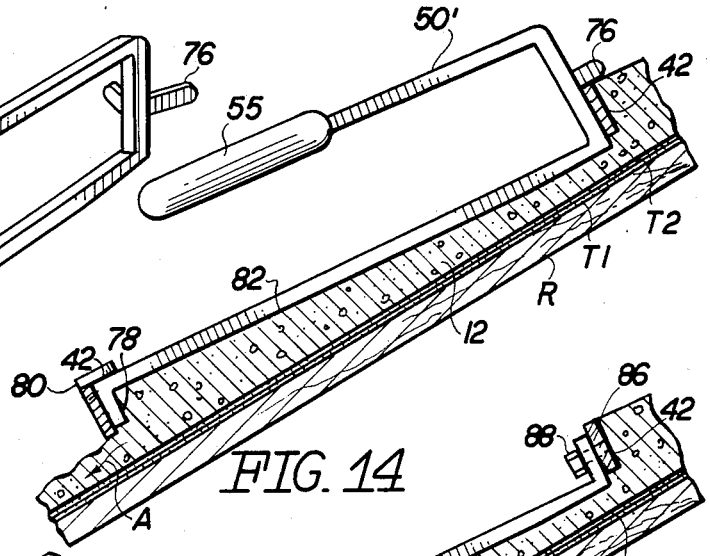
FIG. 14 is an elevation section view of the movable spacer bar of FIG. 13 in use.

Referring now to FIGS. 13 and 14, the alternate and preferred embodiment of the movable spacer bars is shown at 50' and includes at one end support fingers 76 which supportively rest on the top edge of a dam bar 42. At the other end of the movable spacer bar 50' is a support tab 80 and an end form bar 78. The support tab 80 supportively rests atop the edge of the next lower dam bar 42 as shown. The recess 20 between each panel portion 12 is thus formed by the recess bar portion 82 and the end form bar 78. The handle portion 55 allows quick and positive installation and removal of these movable spacer bars 50 and 50' without interferring with the poured concrete scraping or trowelling process described more fully below.

Figure 15:
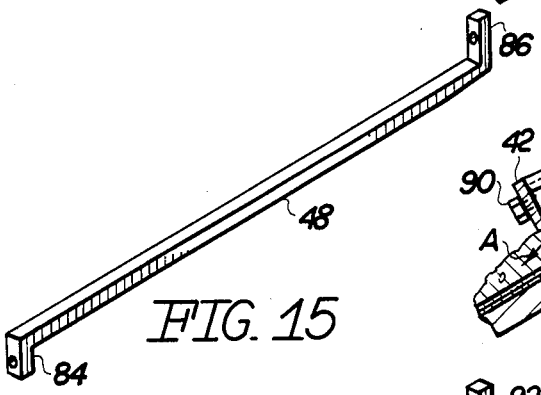
FIG. 15 is a perspective view of the fixed spacer bar.
Figure 16:
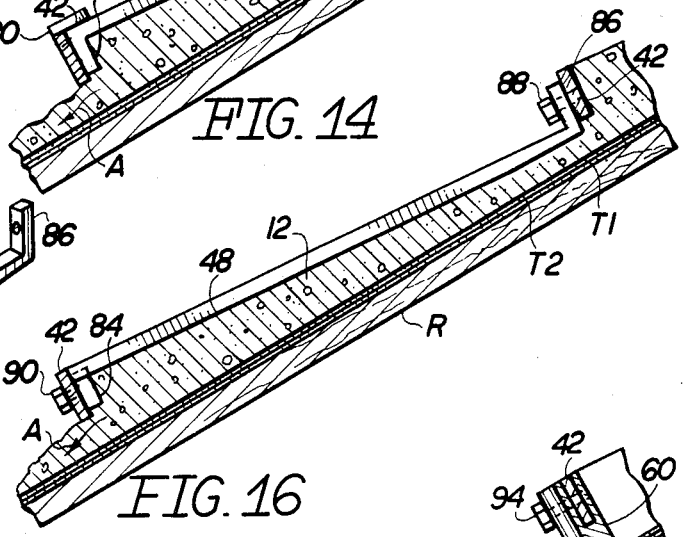
FIG. 16 is an elevation section view of the support spacer bar of FIG. 15 in use.

The support spacer bar 48 is shown more fully in FIGS. 15 and 16 and includes a rigid elongated straight center portion and opposing tabs 84 and 86 at each end for secure, supportive installation between the dam bars 42. Threaded bolts 88 and 90 secure the support spacer bars in position against and between the dam bars 42.

Figure 17:
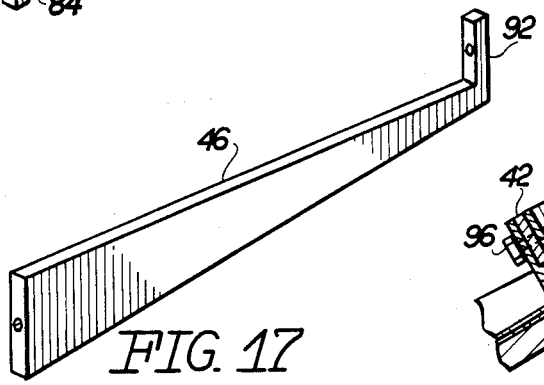
FIG. 17 is a perspective view of the expansion spacer bar.
Figure 18:
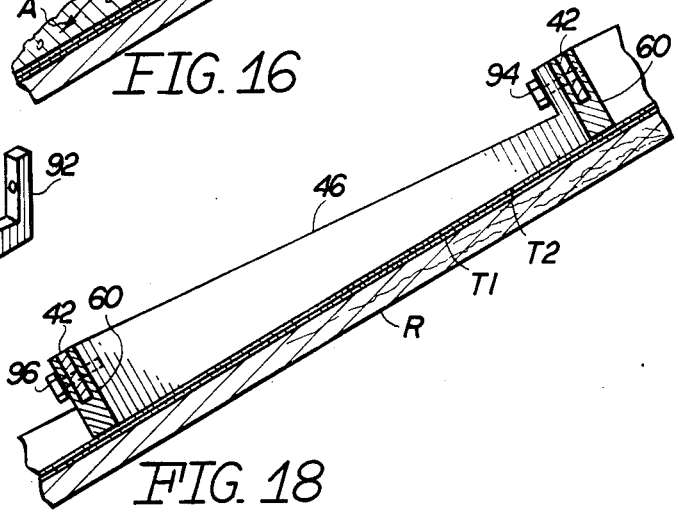
FIG. 18 is an elevation section view of the expansion spacer bar of FIG. 17 in use.

In FIGS. 17 and 18 is shown the expansion spacer bar 46 which is held in position between the dam bars 42 by threaded fasteners 94 and 96. The expansion spacer bar 46 extends downward to the subsurface, tarpaper T2, as does the expansion joint splice block 60, both of which cooperate to form the groove for the elastomer-filled expansion joint 21 previously described.

Figure 19:
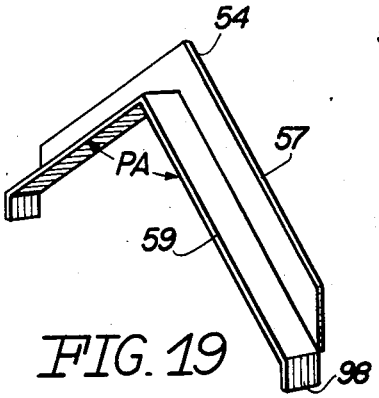
FIG. 19 is a perspective view of the angle peak bar.
Figure 20:
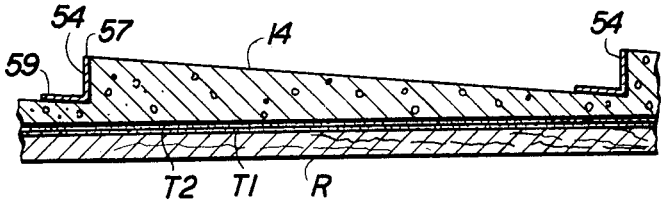
FIG. 20 is an elevation section view of the angle peak bar of FIG. 19 in use.

The angle peak bar 54 is shown in detail in FIGS. 19 and 20 and includes adjacent angle section portions which combine to form a peak angle PA which substantially matches that of the roof peak or may also be chosen to be unequal to that of the roof peak to produce other desired appearances in the peak step portion 14. Tabs 98 supportively engage into "L" brackets 59 or 62 as previously described.

Although not shown, Applicant has also provided the addition of gutter fasteners which may be embedded into the partially cured concrete which encapsulates the roof eave at 30 as best seen in FIG. 2. These gutter fasteners are, preferably embedded prior to complete curing of the concrete at eave portion 30. These gutter fasteners are for interconnection of eave gutter sections against the roof eave portion 30 for rain water drainage collection and diversion in a well known manner.

METHOD OF CONSTRUCTION

A roof covering 10 formed of pourable, hardenable material such as concrete is formed in place atop the subsurface, a roof R by first, if desired, spreading and attaching a layer of bituminous felt T1 over the entire roof R, followed by a layer of mineral roofing T2, both previously referred to for simplicity as tarpaper. Dam bars 42 are then laid atop the subsurface, tarpaper T2 in spaced parallel fashion horizontally or transverse to the slope of the roof R. Support spacer bars 48 are then placed transversly to and between the dam bars 42 and fastened in place. After determining the path of any thermal expansion joint(s), the appropriate expansion spacer bars 46 along with expansion joint splice blocks 60 are fastened in place, also positioned transversly to and between the dam bars 42. The dam bars 42 are now displaced and held above the subsurface, tarpaper T2 a certain distance referred to as a flow slot, supported thusly by the expansion joint splice bars 60.

The subsurface at peak grid 53 is then assembled over the peak P by interconnecting side bars 56 and angle peak bars 54 so as to evenly span the peak P. Riser blocks 58 support the side bars 56 above the subsurface to form a flow slot therebetween. Where desired, the eave form 44 and edge form 52 may also be here installed. Note that the edge form 52 may also be reversed and abutted against the edge of the roof R to eliminate any encapsulation there. Where there is a roof valley V, a valley bar 74 may be here installed along with telescoping collars 72 and corner plate 70. The grid system 40 is now in ready position for pouring the concrete therein.

The preferred concrete pouring sequence begins at the peak P, where concrete is poured between the side rails 56. A small amount of concrete is forced under each angle peak bar 54 and through the flow slot between the bottom edge of the side bars 56 and the subsurface. When sufficient concrete has been poured or pumped into the peak grid 53, excess concrete is scraped or screened away down to the planes defined by the top edge of each step of a side bar 56, the top edge of one side of the upright web 57 of one angle peak bar 54 and the bottom surface of the near horizontal web 59 of the adjacent angle peak bar 54.

After the variable width row 16, has been poured and scraped on either side of the now poured peak cover 13, more concrete is then poured down to and under the next adjacent dam bar 42 in the direction of arrows A in FIGS. 14 and 16. Scraping the excess concrete is done down to the top edge of the lower dam bar 42, and the top edge of the support and expansion spacer bars 48 and 46. This thusly defined plane of each row 11 is coplanar with the bottom edge of the adjacent upper dam bar 42. Immediately after scraping a particular row 11, the movable spacer bars 50 or 50'' are embedded into the wet concrete and seated into position between the adjacent dam bars 42 such that the top surface of each movable spacer bar 50 or 50' is also coplanar with this struck off concrete planar surface and forms the remainder of the recesses 20.

Pouring and scraping the concrete continues down the side of the roof to the eave and eave form 44. Accomplishing the encapsulation of both roof eave E and edge by concrete should now be well understood.

Where sufficient support manpower is unavailable, one side of the roof subsurface may be poured over at a time. However, it is then preferred that the first poured side begin at the uppermost row having recesses 20 and expansion joints 22. The peak cover 13 and unrecessed variable width rows 16 are then accomplished at the beginning of pouring the other side of the roof before preceeding downward with pouring and scraping the second side.

Removal of both movable spacer bars 50 or 50', should be accomplished before the concrete is fully cured and hard so as to aid in this removal process.

These spacer bars 50 or 50' may then be used on the lower poured sections or stored for reuse.

While the instant invention has been shown and described herein in what is conceived to be the most practical and preferred embodiment, it is recognized that departures may be made therefrom within the scope of the invention which is therefore not to be limited to the details disclosed herein but is to be accorded the full scope of the claims so as to embrace any and all equivalent apparatus and articles.

What is claimed is:

1. A monolithic roof covering for installation atop the subsurface a sloped roof, said roof covering comprising:

a plurality of generally horizontally disposed adjacent, parallel, simulated rows of panel portions, said simulated rows collectively covering the entire roof subsurface from peak to eave;

said roof covering monolithic from peak to eave;

each said simulated row generally horizontally disposed and defined by adjacent, parallel row edges generally vertically disposed and spaced above the roof subsurface;

each said simulated row having a top surface formed by the top surfaces of said panel portions;

each panel portion defined by a recess line disposed generally in alignment with the slope of the roof subsurface, each said recess line penetrating partially into said simulated row top suface but not to the roof subsurface;

the lower horizontal edge of each said simulated row defining the upper horizontal edge of each downwardly adjacent said simulated row such that said roof covering has a stepped simulated row configuration as it progresses down the slope of the roof subsurface;

said roof covering cast formed in place atop the roof subsurface of curable and hardenable cementitious material in its precured state.

2. A monolithic roof covering as set forth in claim 1, further comprising:

a roof peak cover disposed over the peak of the roof subsurface and defined along its parallel boundaries by generally vertical peak cover edge planes running substantially between roof edges disposed in spaced relationship on either side of the peak;

said roof peak cover continuous and integral with said roof covering and having a stepped configuration exposed top surface from roof edge to edge.

3. A monolithic roof covering as set forth in claim 2, further comprising:

a plurality of cured expanded foam plates embedded within at least a portion of said panel portions;

said foam plates for increased thermal insulation and weight reduction of said roof covering.

4. A monolithic roof covering as set forth in claim 2, wherein:

said lower horizontal edges of the lowest said simulated row along each roof eave also surrounds and encapsulates the roof eave;

the ends of each said simulated row extend to surround and encapsulate the roof edge margins.

5. A monolithic roof covering as set forth in claim 4, further comprising:

a plurality of gutter retaining fasteners embedded into said lower horizontal edges of said lowest simulated row for retaining formed rigid eave gutter sections against said roof eave;

said rigid eave gutter sections thereafter connectable onto said gutter retaining fasteners and against said roof eave for rain water collection and diversion.

6. A monolithic roof covering as set forth in claim 2, further comprising:

an expansion joint of cured elastomeric material extending into said roof covering to the roof subsurface;

said expansion joint running continuously in zig-zag fashion along substantially the entire slope of the roof and coinciding with generally vertically aligned as follows recess lines and segments of said row separation planes.

7. A monolithic roof covering as set forth in claim 2, wherein:

said simulated row highest and adjacent each said peak cover plane is variable in transverse width to accommodate varying roof dimensions;

said highest simulated row having a continuous top surface absent said recesses.

8. A monolithic roof covering as set forth in claim 1, wherein:

said roof covering also extends over the entire roof subsurface from edge to edge;

said roof covering is also monolithic from edge to edge.

* * * * *